US005709491A

United States Patent [19]

Yeh

[11] Patent Number: 5,709,491

[45] Date of Patent: Jan. 20, 1998

[54] PENCIL-LIKE ERASER

[76] Inventor: Thomas Yeh, 10F, No. 97, Sec. 2, Nan-Gun Rd., Taipei, Taiwan

[21] Appl. No.: 580,970

[22] Filed: Jan. 3, 1996

[51] Int. Cl.[6] ..... B43L 19/00

[52] U.S. Cl. ..... 401/88; 15/424; 15/427

[58] Field of Search ..... 15/424, 425, 426, 15/427, 428, 429, 430, 431, 432, 433, 434, 435, 437, 443; 401/88

[56] References Cited

U.S. PATENT DOCUMENTS

| | | | |
|---|---|---|---|
| 342,956 | 6/1886 | Foster | 15/428 |
| 447,873 | 3/1891 | Hanimann | 15/424 |
| 902,164 | 10/1908 | Orchard | 401/88 |
| 4,167,347 | 9/1979 | Hoyle | 15/427 |
| 5,318,372 | 6/1994 | Besthorne | 15/427 |

FOREIGN PATENT DOCUMENTS

| | | | |
|---|---|---|---|
| 546632 | 3/1932 | Germany | 15/428 |

*Primary Examiner*—Randall Chin
*Attorney, Agent, or Firm*—Browdy and Neimark

[57] ABSTRACT

A tubular eraser for erasing ink or pencil marks comprises an elongated body of a rubber material. The elongated body has an insertion hole of a predetermined length and extending along the direction of the axis of the elongated body for accommodating an ink reservoir of a ball-point pen.

3 Claims, 3 Drawing Sheets

PENCIL-LIKE ERASER

FIELD OF THE INVENTION

The present invention relates generally to a pen or pencil eraser, and more particularly to an elongated tubular eraser for erasing ink or pencil marks.

BACKGROUND OF THE INVENTION

The conventional pen or pencil eraser is generally separated from the pen or pencil. The user of the pen or pencil must therefore carry with him or her an eraser made of rubber for erasing ink or pencil marks. Certain pencils have an eraser attached thereto. Such eraser is generally rather small and is therefore used up quickly.

SUMMARY OF THE INVENTION

It is therefore the primary objective of the present invention to provide an eraser, which is combined with a ball-point pen.

It is another objective of the present invention to provide a pencil eraser, which can not be used up in a short period of time.

The foregoing objectives of the present invention are attained by a pencil-like eraser of a rubber material. The eraser is of an elongated construction and is provided axially with an insertion hole of a predetermined length for receiving therein the ink reservoir of a ball-point pen.

The objectives, features and functions of the present invention will be more readily understood upon a thoughtful deliberation of the following detailed description of the present invention in conjunction with the accompanying drawings.

DETAILED DESCRIPTION OF THE INVENTION

Figure 1:
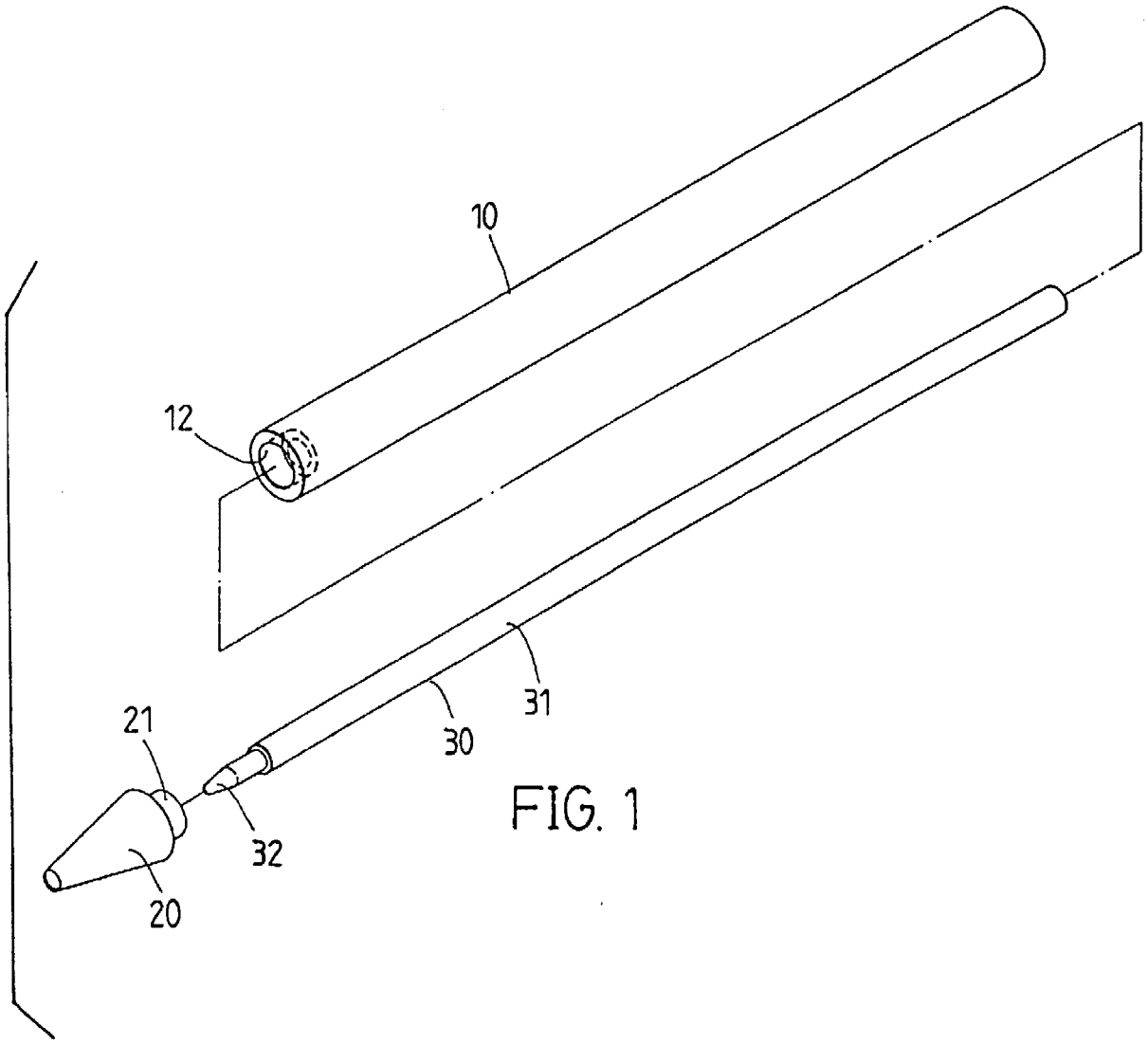
FIG. 1 shows an exploded view of a first preferred embodiment of the present invention.
Figure 2:
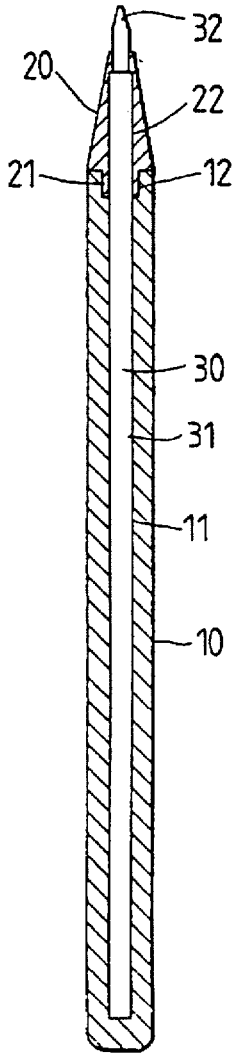
FIG. 2 shows a sectional view of the first preferred embodiment of the present invention in combination.

As shown in FIGS. 1 and 2, an elongated rubber eraser 10 is provided along the direction of the axis thereof with an insertion hole 11 of a predetermined length. The insertion hole 11 is provided at the front end thereof with a retaining groove 12 engageable with a retaining projection 21 of a rigid sleeve 20 of a tapered construction. The rigid sleeve 20 is provided with an axial hole 22 which is aligned with the insertion hole 11 at the time when the sleeve 20 is fastened with the front end of the rubber eraser 10 of an elongated construction. The axial hole 22 and the insertion hole 11 are similar in diameter and are intended for accommodating an ink reservoir 31 of a ball-point pen 30. The ball-point pen has a ball point 32, which is located outside the front end of the axial hole 22 of the sleeve 20. The rigid sleeve 20 serves to stabilize the ball-point pen 30. Any area of the outer surface of the rubber eraser 10 can be used to erase the ink or pencil marks.

Figure 4:
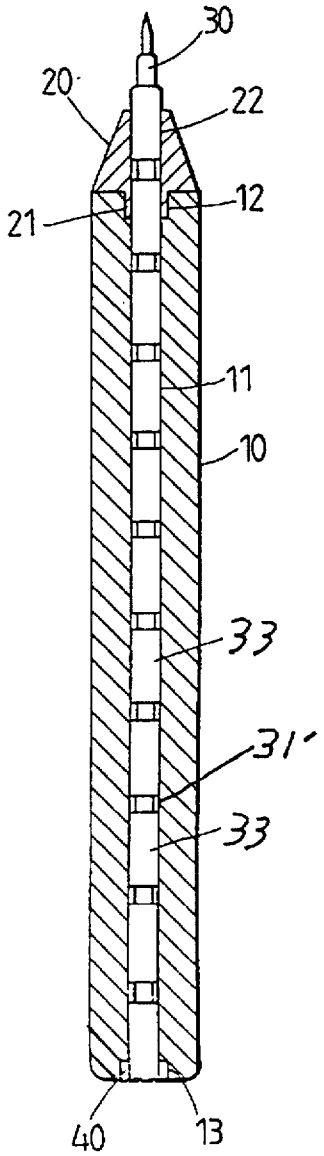
FIG. 4 shows a sectional view of the second preferred embodiment of the present invention in combination.
Figure 3:
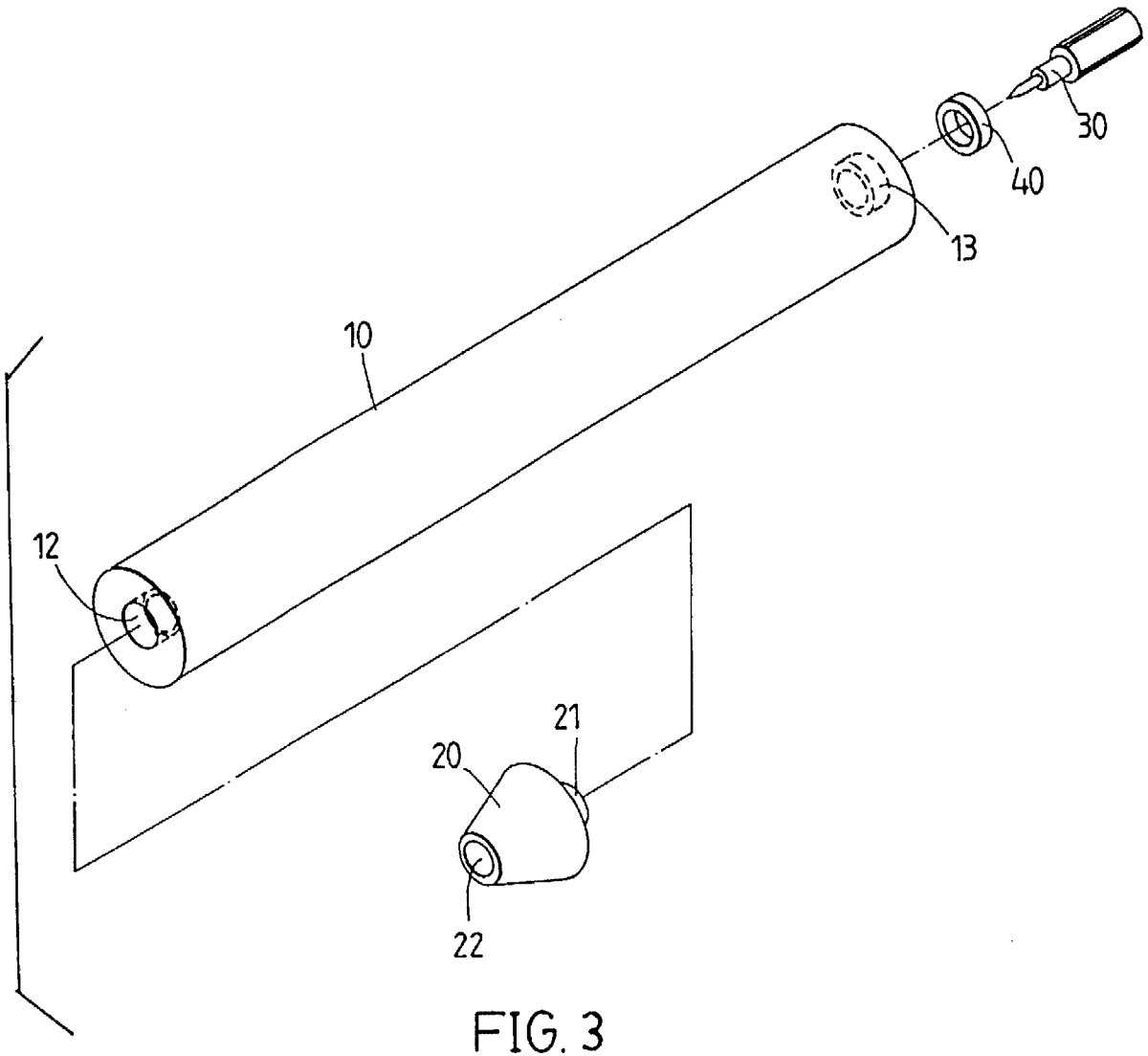
FIG. 3 shows an exploded view of a second preferred embodiment of the present invention.

As illustrated in FIGS. 3 and 4, the rubber eraser 10 of the second preferred embodiment of the present invention is different from the first preferred embodiment of the present invention in that the former is provided with a recess 13 located at the rear end of the insertion hole 11 of the rubber eraser 10. In conjunction with a collar 40, the recess 13 is intended to enable each unit 33 of the ink reservoir 31 to be used in turn.

The rubber eraser 10 of the present invention serves not only as an eraser for erasing the ink or pencil marks but also as a casing for holding an ink reservoir (31, 31') of a ball-point pen. The rubber casing provides writing comfort. In addition, a spent ink reservoir can be replaced with a new one so as to prolong the writing life span of the ball-point pen. In the meantime, the rubber eraser of the present invention serves longer in view of the fact that all areas of the elongated rubber eraser of the present invention can be used to erase the ink or pencil marks.

The embodiments of the present invention described above are to be regarded in all respects as being illustrative and not restrictive. Accordingly, the present invention may be embodied in other specific forms without deviating from the spirit thereof. The present invention is therefore to be limited only by the scopes of the following appended claims.

What is claimed is:

1. A tubular eraser for erasing marks comprising an elongated body of a rubber material and having therein an insertion hole along an axis of said elongated body, said insertion hole having a predetermined length, an ink reservoir of a ball-point pen accomodated in the predetermined length of the insertion hole, a first end of said insertion hole having a retaining groove, a tapered sleeve of a rigid material having a retaining projection, said retaining projection being engaged within said retaining groove, said tapered sleeve provided therein with an axial hole in alignment with said insertion hole of said elongated body when said tapered sleeve is fastened to said elongated body, wherein a ball point of said ball-point pen extends out of said axial hole of said tapered sleeve.

2. A tubular eraser for erasing marks comprising an elongated body of a rubber material and having therein an insertion hole along an axis of said elongated body, said insertion hole having a predetermined length, a plurality of ink reservoirs accommodated in the predetermined length of the insertion hole, a first end of said insertion hole having a retaining groove, a tapered sleeve of a rigid material having a retaining projection, said retaining projection being engaged within said retaining groove, said tapered sleeve provided therein with an axial hole in alignment with said insertion hole of said elongated body when said tapered sleeve is fastened to said elongated body, wherein a ball point of one of said plurality of ink reservoirs extends out of said axial hole of said tapered sleeve.

3. The tubular eraser as defined in claim 2, wherein a second end of said insertion hole is provided with a recess and a collar for enabling said plurality of ink reservoirs to be used in turn.

* * * * *